United States Patent [19]

Nezworski

[11] Patent Number: 4,832,752

[45] Date of Patent: May 23, 1989

[54] CLEANING AND DELIMING GLASS WASHER SPRAY NOZZLES

[75] Inventor: James E. Nezworski, Waukesha, Wis.

[73] Assignee: Perlick Corporation, Milwaukee, Wis.

[21] Appl. No.: 145,263

[22] Filed: Jan. 19, 1988

[51] Int. Cl.[4] ..... B08B 3/04

[52] U.S. Cl. ..... 134/22.12; 134/57 R; 134/98; 134/166 C; 134/169 C

[58] Field of Search ..... 134/72, 78, 96, 98, 134/103, 131, 140, 171, 199, 166 C, 167 C, 169 C, 97, 57 R, 22.1, 22.11, 22.12; 137/239; 239/112, 113

[56] References Cited

U.S. PATENT DOCUMENTS

| | | | |
|---|---|---|---|
| 2,015,566 | 9/1935 | Lowry | 134/98 X |
| 2,558,628 | 6/1951 | Redin | 134/168 C X |
| 2,665,772 | 1/1954 | Greer et al. | 134/96 X |
| 3,076,730 | 2/1963 | Nolte | 134/72 X |
| 3,139,890 | 7/1964 | Moran | 134/72 X |
| 4,287,901 | 9/1981 | Fowler | 134/72 X |
| 4,485,840 | 12/1984 | Erwin | 239/112 X |
| 4,592,305 | 6/1986 | Scharfenberger | 239/112 X |

*Primary Examiner*—Harvey C. Hornsby
*Assistant Examiner*—Frankie L. Stinson
*Attorney, Agent, or Firm*—James E. Nilles; James R. Custin

[57] ABSTRACT

In normal washing operation of the beverage glass washer of the invention, detergent solution discharged from a set of washing nozzles is collected in a tank from which a recirculation pump withdraws it and delivers it back to those nozzles for redischarge; and rinsing liquid from another source is delivered to a set of rinsing nozzles for discharge from them. For cleaning and deliming all nozzles, the tank is filled with a cleaning solution and the two sets of nozzles are connected, either by opening a normally closed solenoid valve in a permanent connection between the two sets of nozzles or by slipping opposite ends of a suitably sized hose over a cylindrical nozzle body of each set. The recirculation pump then flushes the solution from the tank through all nozzles of both sets.

7 Claims, 4 Drawing Sheets

CLEANING AND DELIMING GLASS WASHER SPRAY NOZZLES

FIELD OF THE INVENTION

This invention relates to machines for washing articles such as beverage glasses and is more particularly concerned with apparatus in such a machine for cleaning and deliming the nozzles from which cleansing liquids are discharged against articles to be washed.

RELATED PATENT APPLICATIONS

The applicant's copending application, Ser. No. 117,155, filed Oct. 30, 1987 now pending discloses a glass washing machine having a linearly movable conveyor that carries articles to be washed. A smaller and lower capacity glass washing machine having a rotary carrier for articles to be washed is disclosed in the applicant's copending application, Ser. No. 136,133, filed Dec. 21, 1987. The applicant's copending application, Ser. No. 158,665, filed Feb. 22, 1988 now pending relates to improvements in glass washing machines which ensure that all glasses passing through such a machine will be subjected to thorough wetting with each type of cleansing liquid discharged in the machine. All of these applications are assigned to the assignee of this application.

BACKGROUND OF THE INVENTION

In most localities, commercial establishments such as taverns and restaurants are no longer permitted to wash beverage glasses by hand, and the machines by which such glasses are washed are required to meet standards set by the National Sanitation Foundation. These standards require that glasses be subjected to a thorough soil-removing spray of a detergent solution at a temperature of at least 120° F., followed by a thorough spray with a germicidal rinsing solution.

It is obvious that total sanitization of beverage glasses cannot be consistently and assuredly achieved with a glass washing machine that has one or more of its spray nozzles blocked by foreign matter that prevents or substantially reduces the discharge of cleansing liquid. In relation to the very important public health implications of such spray nozzle blockages, the prior art relating to glass washing machines reflects a disproportionately small attention to the problem. Glasses to be washed in a tavern or restaurant often contain foreign matter such as berry seeds, fruit pulp or bits of paper napkin that is washed off of them and carried in the cleansing liquid discharged from certain of the nozzles. In machines wherein such cleansing liquid is collected in a retention tank and pumped back to those nozzles, a screen is usually provided through which the collected liquid must pass before it arrives at the recirculation pump, intended to prevent foreign matter from being carried back to the nozzles and blocking them. Most such screens heretofore provided have had some deficiency. In some cases, the screen permitted some foreign matter to escape and pass into the nozzles; in other cases the screen was so arranged that foreign matter trapped by it could fall into the recirculation outlet when the screen was removed for cleaning; and in many cases the screen could be readily blocked by foreign matter to such an extent that there was a substantially diminished flow back to the nozzles through it, so that there was insufficient discharge from the nozzles even though they themselves were not blocked. As a result of these deficiencies, it is known that glass washing machines have often been permitted to operate—sometimes for prolonged periods—with an unnoticed or disregarded blockage that resulted in incompletely cleansed glasses.

The above mentioned copending application, Ser. No. 117,155, discloses effective screening means for assuredly preventing blockage of nozzles by foreign matter carried in recirculated cleansing liquid and for causing the machine to shut down in response to any condition that might cause a diminished flow of recirculated liquid back to nozzles from which such liquid had been discharged.

But even with absolute assurance against blockage by solid or semi-solid materials, the nozzles of a glass washing machine can in time become partially or wholly blocked by substances normally dissolved in the cleansing liquid itself. In an efficient glass washing machine such as is disclosed in each of the above mentioned Ser. Nos. 117,155 and 136,133, hot detergent solution is discharged from a set of washing nozzles while cooler germicidal solution is discharged from a set of rinsing nozzles, and such discharge continues for a predetermined interval, on the order of 30 seconds to 2 minutes. The machine then shuts down and remains out of operation for an indefinite period that may range from a few seconds to several hours. When the machine stops, liquid drains away from all of the nozzles, leaving them wet. During the subsequent period of shutdown, the water component tends to evaporate out of the solutions that wet the nozzles, leaving on them residue deposits that may partially block their outlets. When the machine is restarted, the hot detergent solution that flows through the washing nozzles tends to dissolve the residue on them rather quickly, and therefore blockage of the washing nozzles by residue deposits is seldom a problem, although it can occur. However, the germicidal chemical in the rinsing solution seems to react with minerals naturally present in many water supplies, and especially with the iron often present in well water, producing a precipitate residue that is not readily dissolved by the rinsing solution itself. Hence, the residue on the rinsing nozzles, instead of being washed away during each operating cycle, tends to build up through successive cycles until the discharge of rinsing solution is eventually reduced to such an extent that glasses put through the machine are not properly sanitized. Since the outlet opening in a glass washer spray nozzle is very small—typically about 1 mm diameter—only a relatively small buildup of residue can materially reduce the rate of discharge from such a nozzle.

Thus, satisfactory operation of a glass washing machine requires periodic cleaning of all of its spray nozzles. Prior glass washing machines have made no provision for such cleaning of the nozzles, other than to arrange the nozzle assemblies for more or less ready removal to facilitate manual cleaning. This was a serious deficiency because discharges from the nozzles ordinarily cannot be observed while the machine is in operation, and therefore the need for nozzle cleaning did not become apparent until the performance of the machine had deteriorated to the point of being hazardous to public health. Even then, the difficult and tedious work needed to correct the condition tended to discourage prompt action.

SUMMARY OF THE INVENTION

The general object of this invention is to provide means in a beverage glass washing machine whereby all of the spray nozzles of the machine can be cleaned quickly, effectively and with a minimum of labor and effort.

A more specific but very important object of the invention is to provide, in a beverage glass washing machine, means for quickly and easily converting the machine from a normal glass washing mode to a nozzle cleaning mode that provides for effective automatic cleaning of all of the spray nozzles of the machine, so that the person responsible for operation of the machine can be instructed to clean the nozzles at regular fixed intervals and can be expected to follow such instruction because it is simple and easy to do so.

It is also an object of this invention to provide simple and effective nozzle cleaning means in a glass washing machine of the type having a plurality of spray nozzles from which cleansing liquids are discharged, a tank wherein substantially all of the liquid discharged from certain of the nozzles is collected, and a recirculation pump whereby liquid is withdrawn from that tank and fed back to those nozzles for redischarge from them, said nozzle cleaning means being so arranged that chemical can be added to water in said tank to produce a nozzle cleaning and deliming solution and, in response to actuation of a switch, the recirculation pump can be caused to draw such solution from that tank and deliver it to all of the nozzles for flushing through them.

A further object of the invention is to provide, in a generally conventional glass washing machine wherein hot detergent solution discharged from washing nozzles is collected in a retention tank and is normally pumped back only to those nozzles for redischarge from them, means whereby the machine can be temporarily converted at will to a nozzle cleaning mode wherein liquid from the tank can be pumped to all of the other nozzles as well as to the washing nozzles, such delivery to the other nozzles being then effected by the same recirculation pump that otherwise delivers only to the washing nozzles.

It is also a more specific object of the invention to provide nozzle cleaning means in a glass washing machine, operative only in a nozzle cleaning mode to which the machine can be quickly and easily converted, whereby nozzle cleaning solution drawn from a retention tank and flushed through all of the nozzles is partially returned to the tank for reuse and partially drained away, so that by reason of such partial recirculation a tank full of the solution will normally suffice for thorough cleaning of all of the nozzles, even under extreme conditions of residue buildup on them, and the time required for effecting such cleaning is substantially predetermined.

Another specific object of the invention is to provide means in a glass washing machine of the above described character for readily converting it from its normal glass washing mode to an automatic nozzle cleaning mode wherein detergent solution that had previously been used for glass washing is employed for cleaning all of the nozzles.

BRIEF DESCRIPTION OF THE DRAWINGS

In the accompanying drawings, which illustrate what are now regarded as preferred embodiments of the invention.

DETAILED DESCRIPTION OF PREFERRED EMBODIMENTS OF THE INVENTION

Figure 1:
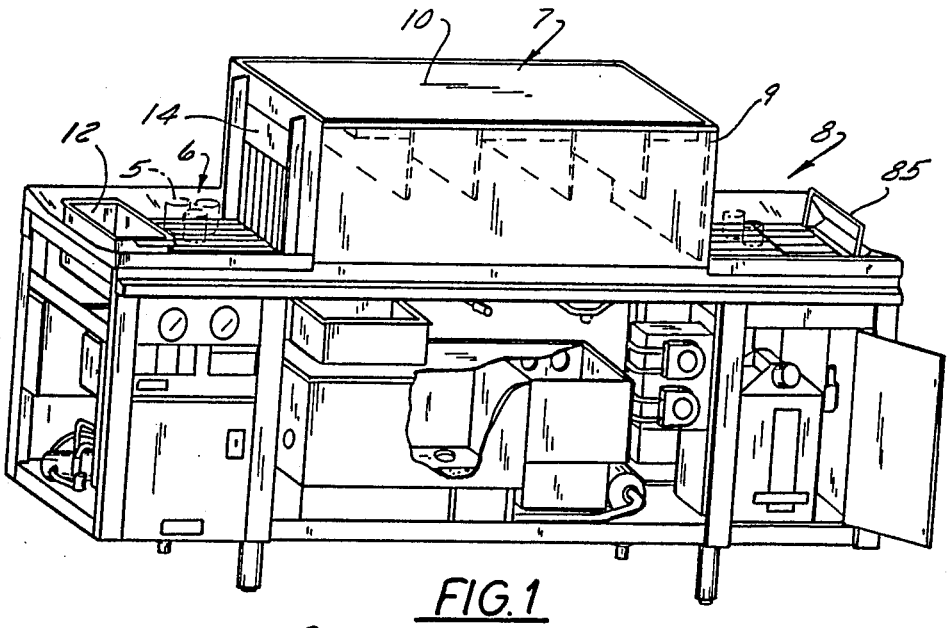
FIG. 1 is a perspective view of a high capacity glass washing machine that embodies the present invention.
Figure 2:
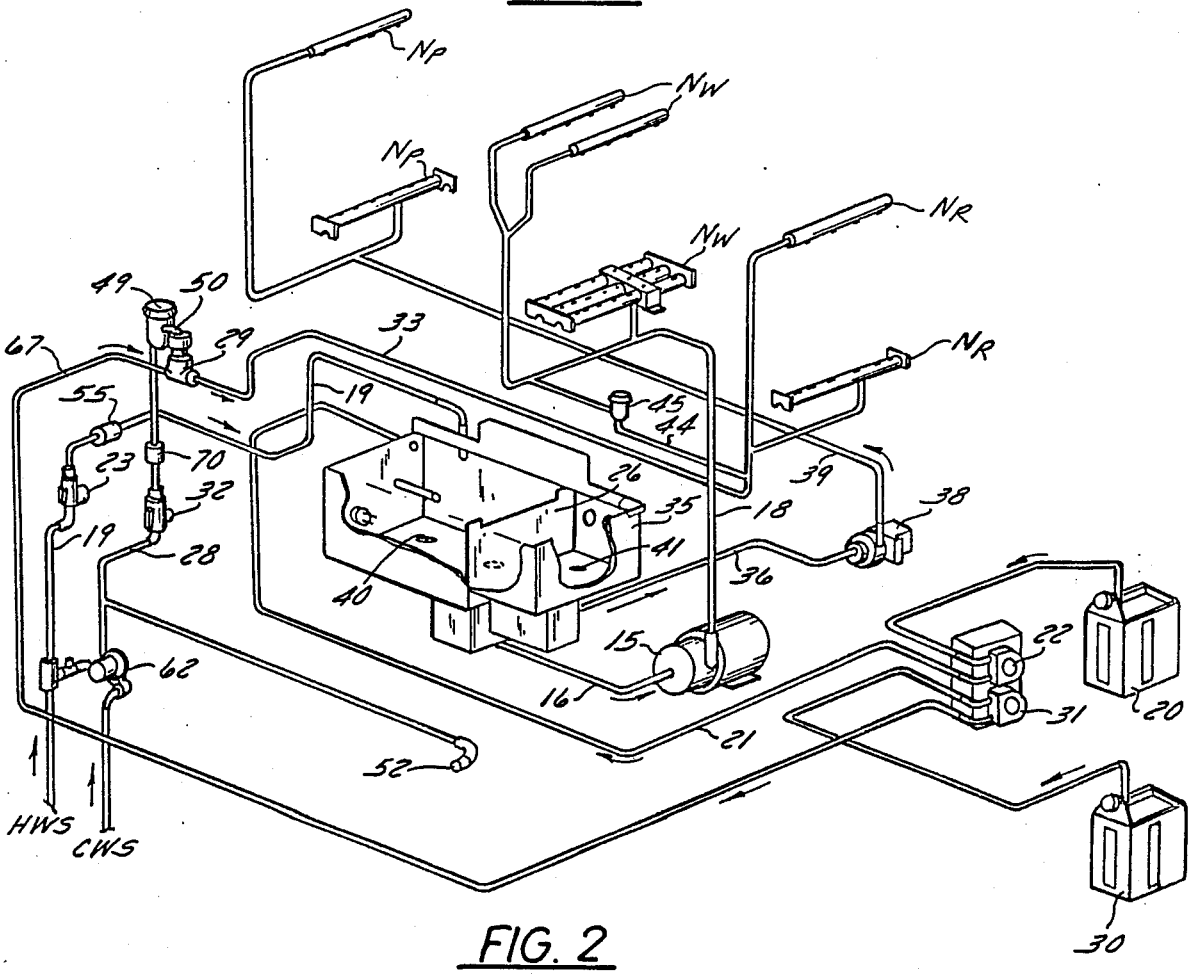
FIG. 2 is a diagram of the liquid flow systems of the machine shown in FIG. 1.
Figure 4:
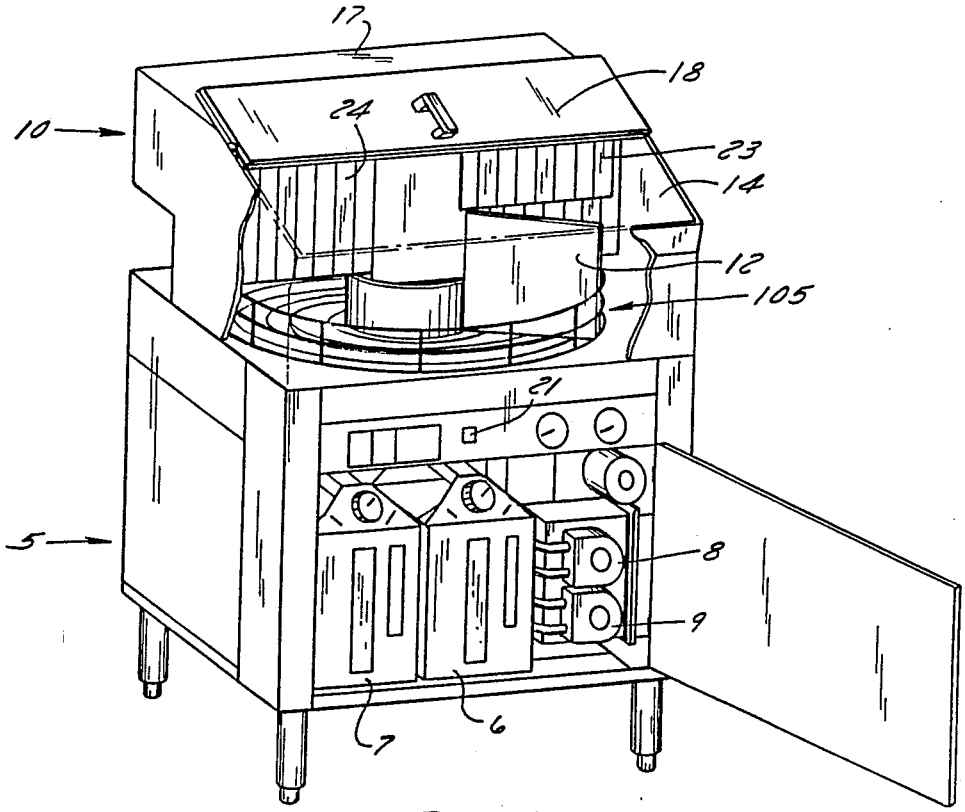
FIG. 4 is a perspective view of another and somewhat smaller glass washing machine that embodies the invention in a modified form.
Figure 3:
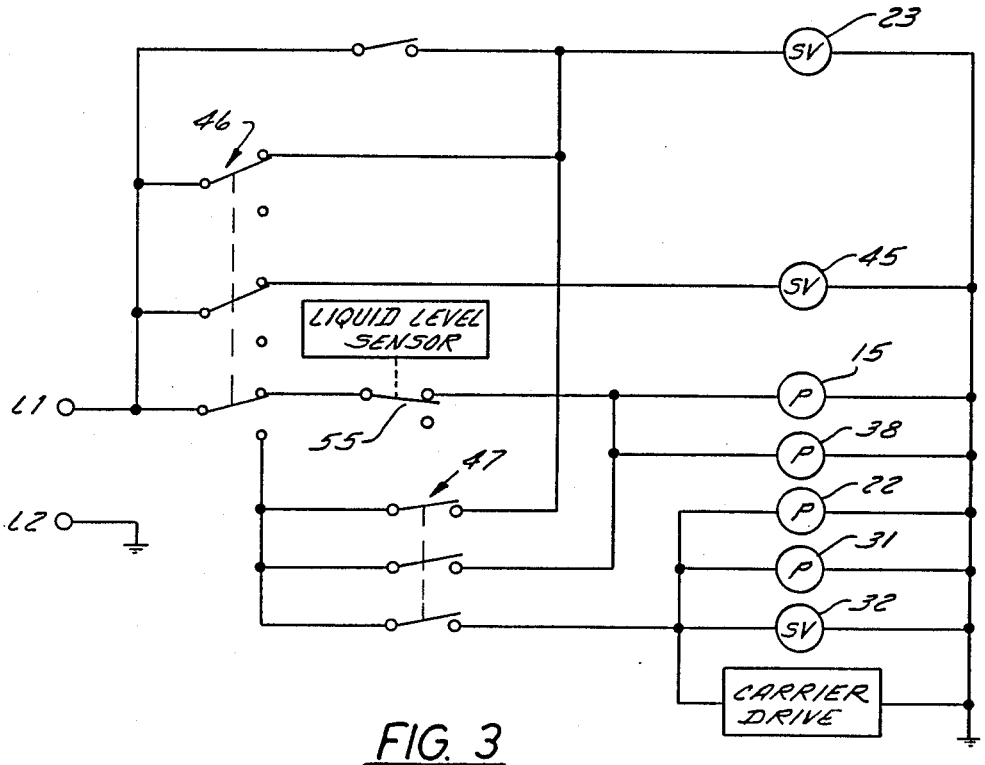
FIG. 3 is a simplified electrical circuit diagram for the machine of FIGS. 1 and 2.
Figure 5:
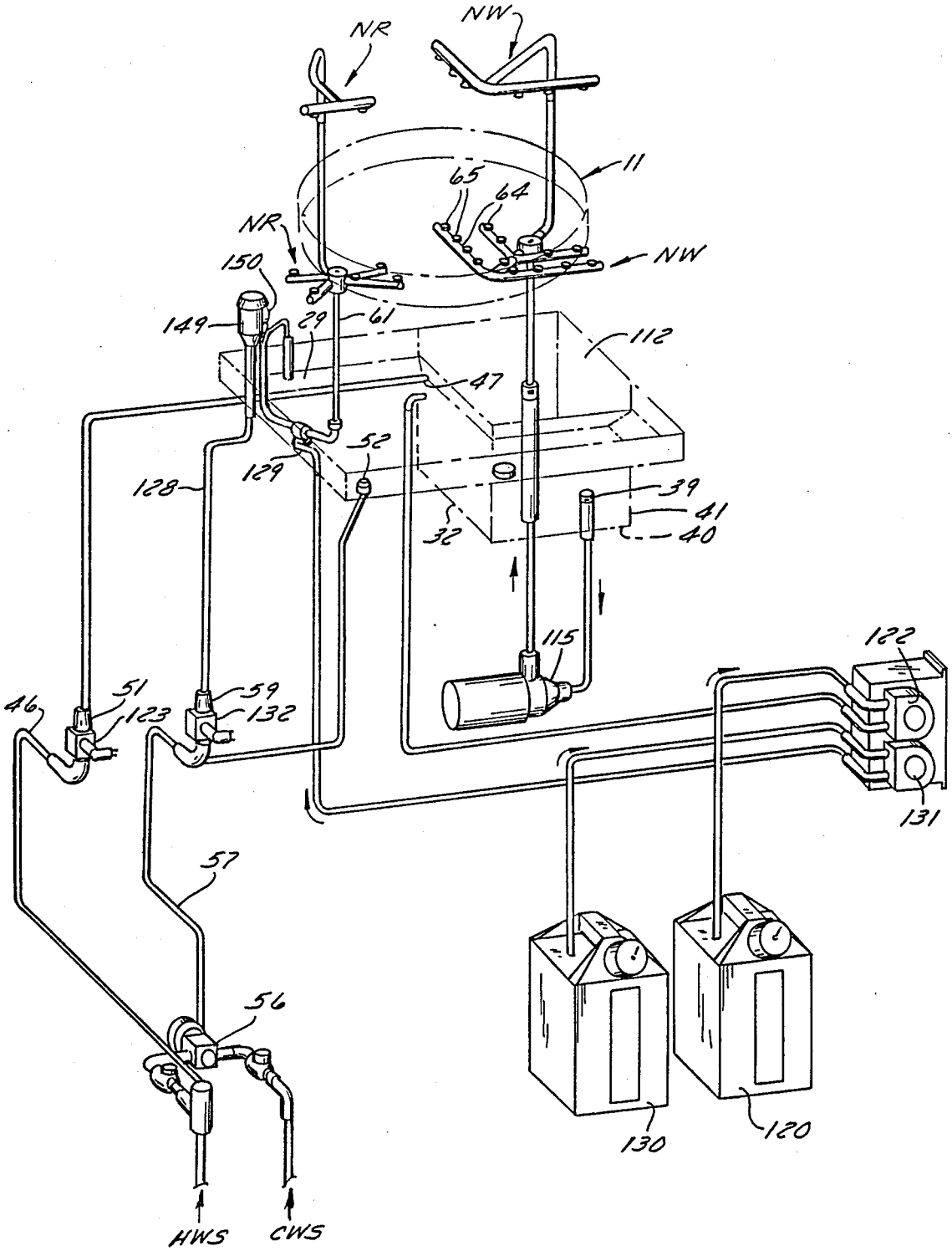
FIG. 5 is a diagram of the liquid flow systems of the machine shown in FIG. 4, with the machine in its normal glass washing mode.
Figure 6:
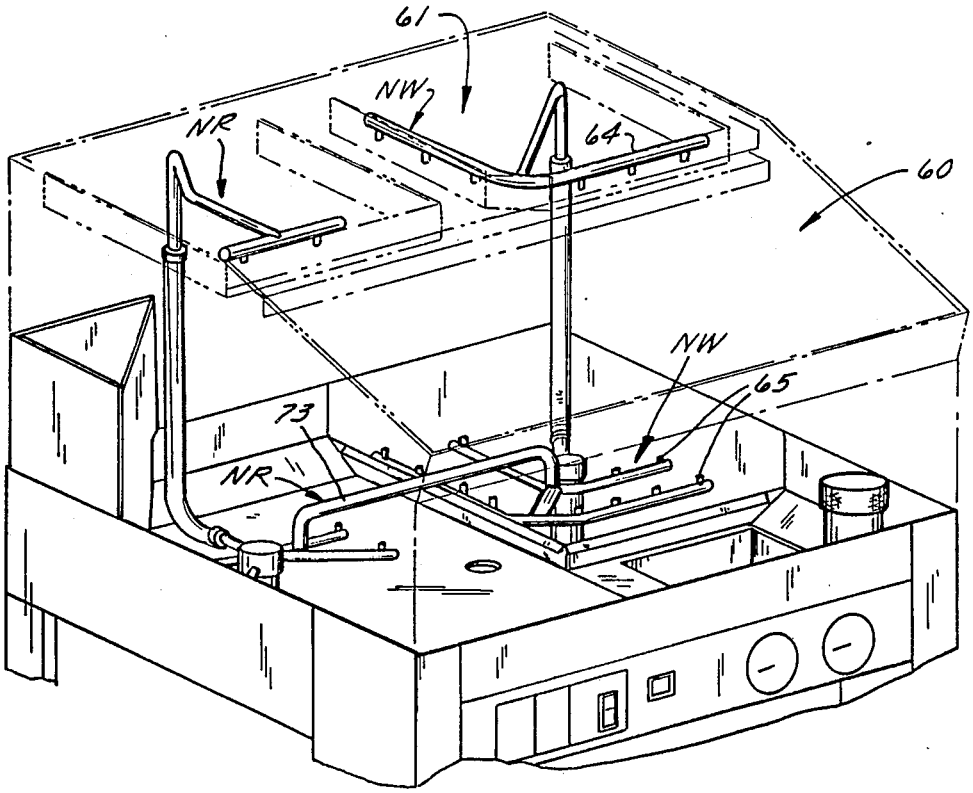
FIG. 6 is a more or less diagrammatic perspective view of the upper portion of the machine shown in FIG. 4 in its adaptation for its nozzle cleaning mode.

FIGS. 1–3 illustrate a beverage glass washer particularly suitable for restaurant-bar operations, having an elongated grid-like linear carrier 5 on which glasses are transported from a loading zone 6 at one end of the carrier, through a cleansing zone defined by a tunnel-like enclosure 7 wherein the glasses are sprayed with liquids, and to an unloading zone 8 at the other end of the carrier. This machine is here illustrated and described only to the extent that its construction and manner of operation are pertinent to the nozzle cleaning apparatus of the present invention, which is incorporated therein. For further information about the machine, reference can be made to the above mentioned copending application, Ser. No. 117,155.

In the tunnel-like cleansing zone enclosure 7 there are three sets of nozzles $N_P$, $N_W$ and $N_R$, the nozzles of each set consisting of an upper group mounted just beneath the top wall 10 of the tunnel and discharging downwardly and a lower group mounted beneath the carrier 5 and discharging upwardly through it. As glasses on the carrier move through the cleansing zone, they are first sprayed with prewash liquid discharged from the set $N_P$ of prewash nozzles, then with a hot detergent solution discharged from the set $N_W$ of washing nozzles, and finally with germicidal rinsing solution discharged from the set $N_R$ of rinsing nozzles.

Substantially all of the detergent solution discharged from the washing nozzles $N_W$ is collected in a wash tank 12 mounted beneath those nozzles, falling into that tank through a screening vessel (not shown) over the top of it that catches at least the major portion of the foreign matter carried in the solution. A wash pump 15 withdraws liquid from the wash tank 12 through a first recirculation duct 16 and delivers it back to the washing nozzles $N_W$ for redischarge from them, through a second recirculation duct 18. For such recirculation, the tank 12 has in its bottom a recirculation outlet (not shown) to which the first recirculation duct 16 is connected and across which there is an inclined fine-mesh screen (not shown) that catches any foreign matter which may have escaped the screening vessel.

When the machine is in glass washing operation, hot water from a source HWS thereof at utility system pressure is delivered into the wash tank 12 through a hot water duct 19, and detergent chemical from a reservoir 20 is pumped into that tank through a detergent duct 21 by means of a detergent pump 22. A normally closed hot water solenoid valve 23 in the hot water duct 19 is energized to its open condition to permit such inflow of hot water. If detergent solution in the wash tank should fall to a critically low level, a switch 55 that is responsive to the level of liquid in the wash tank opens the energizing circuits to effect a complete shutdown of the machine. This could occur upon substantial blockage of the screening vessel (not shown) through which detergent solution falls into the wash tank after discharge from the washing nozzles. Such shutdown prevents glasses from being passed through the machine without being completely washed. For simplicity, FIG. 3 does not fully depict the liquid level responsive switch 55 (which is in fact a DPDT switch) nor its connections. For further information about it, reference can be made to the above-mentioned Ser. No. 117,155.

When the machine is in glass washing operation, the constant-volume detergent chemical pump 22 is always energized along with the hot water solenoid valve 23 so that hot water and detergent chemical are delivered to the wash tank in predetermined proportions to maintain the detergent solution at a predetermined concentration.

Whenever the machine shuts down during glass washing operations, detergent solution flows by gravity from the washing nozzles $N_W$, through the centrifugal-type wash pump 15 and back to the wash tank 12. When the machine is washing, the wash tank is normally nearly full; hence, such return of detergent solution often causes some overflow from it, which takes place across one wall 26 of the wash tank 12 that serves as a weir. The overflow liquid, after being used for prewash as described hereinafter, is discarded to drain. The rate of introduction of makeup liquid is substantially lower than the rate at which the wash pump 15 recirculates detergent solution through the washing nozzles $N_W$, but the makeup and overflow are sufficient to prevent the solution from becoming excessively soiled.

For mixing of germicidal solution to be discharged from the rinsing nozzles $N_R$ there is a cool water duct 28 which extends from a source CWS of cool water at utility pressure to one inlet of a mixer 29. To the other inlet of the mixer 29 a constant-volume germicide pump 31 delivers germicidal chemical drawn from a reservoir 30. The flow of water to the mixer 29 is controlled by a normally closed cool water solenoid valve 32 which is energized to its open condition, concurrently with energization of the germicide pump 31, whenever the machine is in washing operation. The outlet of the mixer 29 is communicated through a rinsing liquid duct 33 with the rinsing nozzles $N_R$ so that mixed rinsing liquid is delivered to those nozzles by utility system pressure.

The liquid discharged from the rinsing nozzles $N_R$ is collected and conducted into a prewash tank 35 that is separated from the wash tank 12 by the above mentioned weir wall 26. Thus, detergent solution which has overflowed from the wash tank enters the prewash tank 35 and mixes with the used rinsing liquid therein to provide a prewash liquid that is delivered to the prewash nozzles $N_P$ by means of a centrifugal-type prewash pump 38. The prewash pump is connected by means of a first prewash duct 36 with an outlet in the bottom of the prewash tank across which there is a fine mesh inclined screen (not shown) and is communicated with the prewash nozzles $N_P$ through a second prewash duct 39. It will be noted that germicidal solution discharged from the rinsing nozzles $N_R$, after once passing over glasses, is used only for prewash and is conducted to the waste drain after being discharged from the prewash nozzles $N_P$.

The wash tank 12 has a drain outlet 40 in its bottom, and the prewash tank likewise has a drain outlet 41. Although these drain outlets can be normally closed by removable plugs, they are preferably connected with a manifold and controlled by a single normally closed solenoid drain valve cooperating with a check valve as disclosed in the above-mentioned application Ser. No. 117,155.

Apparatus of the present invention, for cleaning and deliming all of the nozzles $N_P$, $N_W$ and $N_R$, comprises a connecting duct 44 which provides for communication between the recirculation duct 18 and the rinsing liquid duct 33, a nozzle cleaning solenoid valve 45 arranged for normally blocking flow through the connecting duct 44 but energizable to an open condition in which such flow is permitted, and a manually operable switch 46 that is selectably actuatable to each of a pair of alternative conditions, one for glass washing and the other for nozzle cleaning.

When the switch 46 is in its washing condition, it provides for connecting an electric power supply $L_1$, $L_2$ with a manually operable starting switch 47, actuation of which causes energization of the drive for the carrier 5, the recirculation pumps 15 and 38, the solenoid valves 23 and 32 and the chemical pumps 22 and 23, so that the glass washing operations are performed as described above. However, the nozzle cleaning solenoid valve 45 in the connecting duct 44 remains unenergized and closed, to prevent mixing of detergent solution being delivered to the washing nozzles $N_W$ with germicidal solution being delivered to the rinsing nozzles $N_R$. A vacuum breaker 49 in the cool water duct 28, between the cool water solenoid 32 and the mixer 29, allows all rinsing solution downstream from it to drain out through the rinsing nozzles $N_R$ whenever the machine shuts down, preventing any possible entry of germicide solution into the water source. At shutdown, prewash liquid also drains by gravity from the prewash nozzles $N_P$, through the prewash pump 38 and back to the prewash tank 35. Thus, when nozzle cleaning is to take place, all ducts that deliver solutions to the nozzles will be empty.

With a machine incorporating the present invention, nozzle cleaning can readily be accomplished daily, either at the end of each day's glass washing operations or, preferably, before the beginning of daily operations. For such routine nozzle cleaning, the retention tanks 12 and 35 are not emptied, and the detergent solution in the wash tank 12 is flushed through all of the nozzles as a nozzle cleaning solution. The mode selector switch 46 is placed in its nozzle cleaning condition, in which it is shown in FIG. 3 and in which it prevents energization of the carrier, the cool (rinsing) water solenoid valve 32 and the chemical pumps 22 and 31. With the selector switch 46 in this nozzle cleaning condition, the wash pump 15, the prewash pump 38 and the nozzle cleaning solenoid valve 45 are energized, and the hot water solenoid valve 23 also remains energized and is therefore open.

The carrier remains unenergized through the nozzle cleaning operation as a safety feature, to prevent glasses from moving through the cleansing zone without being completely and properly washed and sanitized.

During nozzle cleaning, the wash pump 15 draws nozzle cleaning solution from the wash tank 12 and delivers it to the washing nozzles $N_W$ as during washing operations; but in addition, because the nozzle cleaning solenoid valve 45 is open, the wash pump also delivers nozzle cleaning solution to the rinsing nozzles $N_R$ for discharge through them. The nozzle cleaning solution discharged from the washing nozzles $N_W$ is returned to the wash tank 12 for recirculation, as with detergent solution during a glass washing operation; and the nozzle cleaning solution discharged from the rinsing nozzles $N_R$ is collected in the prewash tank 35, from which it is delivered to the prewash nozzles $N_P$ by the prewash pump 38. Since the prewash tank 35 has a relatively small capacity, the rinsing solution that has remained in it is soon pumped through the prewash nozzles and discharged to drain, so that after a short period of the nozzle cleaning operation only detergent solution that has passed through the rinsing nozzles is being delivered to the prewash nozzles.

In the duct 28 for cool rinsing water there is a check valve 50, just downstream from the vacuum breaker 49, which closes during nozzle cleaning to prevent nozzle cleaning solution from being forced backward into the vacuum breaker under the pressure of the wash pump.

During nozzle cleaning, the hot water solenoid valve 23 remains open, so that fresh hot water constantly flows into the wash tank. However, because of the capacities of the wash pump 15 and prewash pump 38, the rate at which nozzle cleaning solution is delivered to the prewash nozzles $N_P$ and thus drained away is greater than the rate at which hot water enters the wash tank. Hence, the liquid level in the wash tank 12 gradually falls until it reaches the critical level at which the liquid level responsive switch 55 shuts off the wash pump and the prewash pump thus terminating withdrawal of liquid from the wash tank. However, the hot water solenoid valve 23 remains open and energized, so that hot water continues to enter the wash tank until it is nearly full, whereupon the switch 55 snaps to a condition in which the wash pump and prewash pump are again energized. There is thus a continuous alternating rise and decline of the liquid level in the wash tank. Meanwhile, because no chemical is being added to the nozzle cleaning solution, the concentration of that solution decreases with the continuing delivery of hot water into the wash tank until, after about three cycles of rise and fall of wash tank liquid level, practically pure water is being flushed through all of the nozzles to rinse them. At that time, therefore, the nozzle cleaning operation can be terminated by actuation of the mode selector switch 46 to its glass washing condition.

Where the source water has an exceptionally high mineral content and deposits tend to form on the nozzles in spite of daily nozzle cleaning with detergent solution, an occasional nozzle deliming may be necessary. For this the two retention tanks 12 and 35 are drained and the wash tank 12 is refilled with fresh hot water to which a quantity of an acid deliming chemical is manually added. The mode selector switch 46 is then placed in its nozzle cleaning condition, and the operation then proceeds as during routine nozzle cleaning but with the deliming solution employed as the nozzle cleaning solution.

After cleaning or deliming the nozzles, and before the machine is returned to washing operation, it is desirable to rinse the tanks 12 and 35, and especially their screens, and also to rinse other parts of the machine. For this purpose, a hose nipple 52 having a manually actuatable valve can be provided at an accessible location on the machine, tapped into the cool water supply upstream from the cool water solenoid valve 32; and an accessory hose (not shown) that is readily connectable to that nipple can be supplied with the machine.

FIGS. 4–7 illustrate a machine of somewhat smaller capacity, having a glass carrier 105 which rotates about an upright axis. One half of the carrier 105 is in an access zone 60 where glasses are loaded onto it and removed from it; the other half is in a cleansing zone 61 wherein glasses are sprayed with detergent solution discharged from a set of washing nozzles $N_W$ and then with germicidal rinsing solution discharged from a set of rinsing nozzles $N_R$. Each set of nozzles comprises a group of downwardly discharging upper nozzles and a group of upwardly discharging lower nozzles that are mounted beneath the carrier. In this case there is no prewash. When the machine is started, the carrier 105 rotates through 180°, always in the same direction, and then stops until the machine is manually restarted. Discharge of sprays is continuous during carrier rotation and stops when the carrier stops. For further details concerning the construction and mode of washing operation of this machine, reference can be made to the above-mentioned copending application Ser. No. 136,133.

As with the linear conveyor machine, detergent solution is drawn from a wash tank 112 by means of a centrifugal wash pump 15 that delivers it to the washing nozzles $N_W$, and after discharge from those nozzles the solution is collected and returned to the tank 112 for recirculation. A normally closed hot water solenoid valve 23 controls infeed of hot water to the tank from a utility source HWS; and a positive displacement detergent pump 22, normally energized in unison with the solenoid valve 23, delivers detergent chemical into the tank 112 from a detergent reservoir 120. In this case, however, hot water and detergent chemical are fed into the tank 112 during only a predetermined portion of each operating period, and overflow from that tank is directly to drain. This machine, too, has a switch 55 that responds to the level of liquid in the wash tank and effects a complete shutdown if that level reaches a critically low point during glass washing.

As with the linear conveyor machine, rinsing liquid is delivered to the rinsing nozzles $N_R$ under utility source pressure, but in this case the rinsing liquid, after discharge from those nozzles, is conducted directly to drain. A normally closed cool water solenoid valve 32 controls flow of cool water from the utility source CWS towards the nozzles $N_R$, and on its way to those nozzles the water passes through a mixer 29 to which germicidal chemical, drawn from a germicide reservoir 130, is delivered by a constant displacement germicide pump 31. The pump 31 and the cool water solenoid valve 32 are always energized in unison.

As is generally conventional, each set of nozzles comprises one or more nozzle tubes 64 and a plurality of cylindrical nozzle bodies 65 secured to each tube at spaced intervals along it, each nozzle body having its axis normal to the length of the tube and having a substantially coaxial discharge outlet at its outer end. All of the nozzle bodies 65 are, of course, identical with one another. Vertical curtains 72 that separate the access zone from the cleansing zone are readily removable; and, as explained in the copending application, Ser. No. 136,133, the rotary carrier 105 is likewise readily removable to provide for easy access to all of the spray nozzles beneath it.

For nozzle cleaning, the washing nozzles $N_W$ and the rinsing nozzles $N_R$ are interconnected by means of a flexible and resilient tube or hose 73 of a diameter to have a snug but axially slidable fit on the nozzle bodies 65. One end portion of this tube is slid onto any convenient nozzle body 65 in the lower group of washing nozzles $N_W$, and its other end is similarly secured to any convenient nozzle body in the lower group of rinsing nozzles $N_R$. As with the linear conveyor machine, the nozzle cleaning solution can be detergent solution already present in the tank 112 from prior washing operations or, in exceptional cases, a specially but easily prepared deliming solution.

The nozzle cleaning operation is carried out in substantially the same manner as with the first described machine. The electrical circuitry for the rotary carrier machine is also essentially like that diagrammed in FIG. 3, although, of course, the rotary carrier machine does not have the prewash pump 38 or the nozzle cleaning solenoid valve 45. Thus during nozzle cleaning, the carrier drive, the chemical pumps 22 and 31 and the cool (rinse) water solenoid valve 32 remain unenergized; the hot water solenoid valve 23 remains energized and open; and the wash pump 15 is energized under control of the liquid level responsive switch 55. Again, the carrier is inoperative during nozzle cleaning to prevent glasses from being carried through the cleansing zone without being properly cleaned.

With the two sets of nozzles $N_W$ and $N_R$ connected by the flexible tube 73, the wash pump 15 delivers nozzle cleaning solution from the tank 112 to all of the nozzles. The solution discharged from the washing nozzles $N_W$ is returned to the tank for recirculation, while that discharged from the rinsing nozzles is passed directly to drain. While hot water is continuously delivered into the tank 112, the level of solution in that tank 112 alternately falls and rises as the wash pump 15 alternately runs and stops under control of the liquid level responsive switch 55, so that in this case, too, the concentration of the nozzle cleaning solution in the tank is gradually weakened until plain water is being flushed through the nozzles.

It will be understood that the cool water source CWS is protected during nozzle cleaning by a check valve 150 in downstream association with a vacuum breaker 149, both located in the cool water infeed duct 128 whereby the cool water source is connected with the mixer 129.

When the nozzle cleaning operation is completed, the interconnection tube 73 is removed, the carrier 105 is reassembled, the curtains 72 are replaced, and the machine is ready to be returned to normal washing operation.

From the foregoing description taken with the accompanying drawings, it will be apparent that this invention provides apparatus whereby the spray nozzles of a glass washing machine can be cleaned and delimed with a speed and facility which encourages regular performance of that operation so that the machine will always be in a condition to effect total sanitization of glasses passed through it.

What is claimed as the invention is:

1. A machine for washing articles such as beverage glasses, comprising a plurality of nozzels disposed in sets along a defined path and from which liquids are discharged, a carrier on which articles to be washed are carried along said path, a tank whrein substantially all liquid discharged from nozzels of one of said sets is collected, an electrically energizable recirculation pump communicated with said tank for withdrawing liquid therefrom, a recirculation duct communicating the recirculation pump with the nozzels of said one set to provide for delivery to them of liquid withdrawn from said tank, delivery duct means communicated with further nozzels that constitute all of said nozzels other than those of said one set, through which liquid to be discharged from said further nozzels is conducted to them, liquid feed means communicated with the delivery duct means and with a source of liquid apart from said tank, said liquid feed means being electrically energizable to provide for flow of liquid from said source to the delivery duct means but otherwise preventing such flow, and drain means for conducting away from the machine the liquid discharged from said further nozzels, said machine being characterized by means for cleaning all of the nozzels comprising:

A. means for alternatively and selectably establishing or preventing communication between said recirculation duct and said delivery duct means; and B. manually operable switch means (1) connected with said recirculation pump and with said liquid feed means and (2) selectably actuatable to each of a pair of alternative conditions, (a) one of which provides for energization of said recirculation pump and said liquid feed means while communication between said recirculation duct and said delivery duct means is prevented, to provide for normal article washing operaion of the machine, and (b) the other of which leaves said liquid feed means unenergized and provides for energization of said recirculation pump while communication between said recirculation duct and said delivery duct means is maintained, so that liquid withdrawn from said tank is delivered to all of the nozzels by the recirculation pump.

2. The machine of claim 1, further characterized by: said means for alternatively and selectably establishing or preventing communication between said recirculation duct and said delivery duct means comprising (1) connecting duct means communicated with said recirculation duct and with said delivery duct means and (2) a normally closed solenoid valve operatively associated with said connecting duct means to mormally block flow therethrough, said solenoid valve being connected with said switch means to be unenergized when the switch means is in its said one condition and to be energized open for permitting flow through said connecting duct means when the switch means is in its said other condition.

3. The machine of claim 1 wherein one of said nozzles of said one set and one of said further nozzles each comprises a protuberant substantially cylindrical body having a substantially coaxial outlet in an outer end thereof, further characterized by:

said means for alternatively and selectably establishing or preventing communication between said recirculation duct and said delivery duct means comprising a length of tubing having opposite flexible and substantially resilient end portions each of which is coaxially slidable into and out of snugly surrounding engagement with one of said cylindrical bodies.

4. A machine for washing articles such as beverage glasses, comprising a plurality of nozzles disposed in sets along a defined path and from which liquids are discharged, a carrier on which articles to be washed are carried along said path, a tank wherein substantially all liquid discharged from nozzles of one of said sets is collected, an electrically energizable recirculation pump for withdrawing liquid from the tank, a recirculation duct communicating said pump with said nozzles of said one set for delivery to the latter for discharge from them of liquid from the tank, delivery duct means through which liquid is conducted to further nozzles that constitute all of said nozzles other than those of said one set for discharge from said further nozzles, liquid feed means communicated with said delivery duct means and with a source of liquid apart from the tank and electrically energizable to provide for flow of liquid from said source to said further nozzles but otherwise preventing such flow, and drain means for conducting away from the machine the liquid discharged from said further nozzles, said machine being characterized by means for cleaning all of the nozzles comprising:

A. connecting duct means arranged for communicating said recirculation duct with said delivery duct means;

B. a solenoid valve operatively associated with said connecting duct means and normally preventing flow therethrough but energizable to an open condition permitting flow from said recirculation duct to said delivery duct means; and C. manually operable switch means (1) connected with said recirculation pump, said liquid feed means and said solenoid valve and (2) selectably actuatable to each of a pair of alternative conditions, (a) one of which provides for energization of said recirculation pump and said solenoid valve while leaving said liquid feed means unenergized, so that the recirculation pump flushes liquid from the tank through all of the nozzles, and (b) the other of which provides for energization of the recirculation pump and the liquid feed means while leaving the solenoid valve unenergized, for article-washing operation of the machine.

5. The machine of claim 4, further having electrically energizable drive means whereby said carrier is driven, further characterized by:

said manually operable switch means being connected with said drive means to provide for energization thereof only when said switch means is in its said other condition.

6. A machine for washing articles such as beverage glasses, having two sets of nozzles disposed along a defined path and from which liquids are discharged against articles carried along said path, each set of nozzles comprising at least one tube having cylindrical nozzle bodies fixed therto at spaced intervals therealong and protruding laterally therefrom, each said nozzle body having a substantially coaxial outlet at an outer end thereof that is communicated with the interior of the tube, a tank wherein substantially all liquid discharged from one of said sets of nozzles is collected, an electrically energizable recirculation pump communicated with said tank for withdrawing liquid therefrom and communicated with said one set of nozzles for delivering withdrawn liquid thereto for discharge therefrom, liquid feed means communicated with the other of said sets of nozzles and with a source of liquid apart from said tank, said liquid feed means being electrically energizable to provide for flow of liquid from said source to said other set of nozzles for discharge therefrom but otherwise preventing such flow, said machine being characterized by means for cleaning all of the nozzles comprising:

A. a length of tubing having opposite flexible and substantially resilient end portions, one of which is axially slidably and snugly but removably securable to a nozzle body of said one set, and the other of which is similarly securable to a nozzle body of said other set to provide a connection between said two sets of nozzles; and B. manually operable switch means connected with said recirculation pump and with said feed means for controlling energization thereof, said switch means being selectably actuatable to each of a pair of alternative conditions, (1) in one of which said recirculation pump is energized while said feed means remains unenergized, so that with said length of tubing providing said connection, liquid withdrawn from said tank is flushed through all of the nozzles by said recirculation pump, and (2) in the other of which both said recirculation pump and said feed means are energized for normal washing operation with said length of tubing removed from said nozzle bodies.

7. A method of cleaning spray nozzles of a machine for washing articles such as beverage glasses wherein said nozzles are disposed in sets along a defined path and wherein, during washing, articles are carried along said path while liquids are discharged against them from said nozzles, said machine having a tank wherein substantially all liquid discharged from nozzles of one of said sets is collected, a recirculation pump whereby liquid is withdrawn from said tank and is delivered to said nozzles of said one set for discharge from them, and feed means operative during washing to deliver liquid from a source apart from said tank to further nozzles that constitute all of the nozzles other than those of said one set for discharge from said further nozzles, said method being characterized by:

A. filling into said tank a quantity of a nozzle cleaning fluid;

B. preventing liquid from said source from flowing to said further nozzles;

C. connecting said nozzles of said one set with said further nozzles so that the latter as well as said nozzles of said one set are communicated with said recirculation pump; and D. operating said recirculation pump to withdraw nozzle cleaning liquid from said tank and flush it through said nozzles of said one set and said further nozzles.

* * * * *